US010515741B2

(12) United States Patent
Foss-Pedersen et al.

(10) Patent No.: US 10,515,741 B2
(45) Date of Patent: Dec. 24, 2019

(54) FIRE RESISTANT ELECTRIC CABLE

(71) Applicant: Prysmian S.p.A., Milan (IT)

(72) Inventors: Geir Foss-Pedersen, Milan (IT); Oystein Edland, Milan (IT); Yannick Van Den Nieuwendijk, Milan (IT)

(73) Assignee: Prysmian S.p.A., Milan (IT)

( * ) Notice: Subject to any disclaimer, the term of this patent is extended or adjusted under 35 U.S.C. 154(b) by 0 days.

(21) Appl. No.: 16/060,744

(22) PCT Filed: Dec. 9, 2015

(86) PCT No.: PCT/EP2015/079081
§ 371 (c)(1),
(2) Date: Jun. 8, 2018

(87) PCT Pub. No.: WO2017/097350
PCT Pub. Date: Jun. 15, 2017

(65) Prior Publication Data
US 2018/0358152 A1 Dec. 13, 2018

(51) Int. Cl.
*H01B 3/08* (2006.01)
*H01B 7/02* (2006.01)
(Continued)

(52) U.S. Cl.
CPC ..... *H01B 7/295* (2013.01); *H01B 3/082* (2013.01); *H01B 7/0225* (2013.01);
(Continued)

(58) Field of Classification Search
CPC ..... G02B 6/4416; G02B 6/4436; H01B 3/08; H01B 3/082; H01B 7/02; H01B 7/29;
(Continued)

(56) References Cited

U.S. PATENT DOCUMENTS 3,576,940 A * 5/1971 Stone ..... H01B 7/295 174/113 R
5,310,964 A * 5/1994 Roberts ..... G02B 6/4416 174/105 SC (Continued)

FOREIGN PATENT DOCUMENTS

CN 103928172 A * 7/2014 ..... C08K 13/06
CN 103928172 A * 7/2014 ..... C08K 13/06

(Continued)

*Primary Examiner* — Timothy J Thompson
*Assistant Examiner* — Guillermo J Egoavil
(74) *Attorney, Agent, or Firm* — Slater Matsil, LLP

(57) ABSTRACT

A cable includes a conductor and a first semiconductive layer arranged in a radially outer position with respect to the conductor. An insulating layer is arranged in a radially outer position with respect to the first semiconductive layer. A second semiconductive layer is arranged in a radially outer position with respect to the insulating. A conductive screen is arranged in a radially outer position with respect to the second semiconductive layer. A heat block layer is arranged in a radially outer position with respect to the conductive screen. The heat block layer includes a layer made of a fire resistant or a flame retardant halogen-free material. A rubberized glass fiber tape is arranged in a radially outer position with respect to the heat block layer. An outer sheath is arranged in a radially outer position with respect to the rubberized glass fiber tape.

19 Claims, 1 Drawing Sheet

(51) Int. Cl.
*H01B 7/29* (2006.01)
*H01B 7/295* (2006.01)
*H01B 9/02* (2006.01)

(52) U.S. Cl.
CPC ..... *H01B 7/0275* (2013.01); *H01B 7/292* (2013.01); *H01B 9/027* (2013.01)

(58) Field of Classification Search
CPC .... H01B 7/0225; H01B 7/0275; H01B 7/292; H01B 7/295; H01B 9/02; H01B 9/027
USPC ..... 174/105 SC, 121, 106 SC, 107
See application file for complete search history.

(56) References Cited

U.S. PATENT DOCUMENTS

2003/0075354 A1* 4/2003 Kuss ..... H01B 7/295
174/120 R
2014/0290976 A1* 10/2014 Nishi ..... B60L 5/18
174/107

FOREIGN PATENT DOCUMENTS

EP 2413331 A1 2/2012
WO 2014081096 A1 5/2014

* cited by examiner

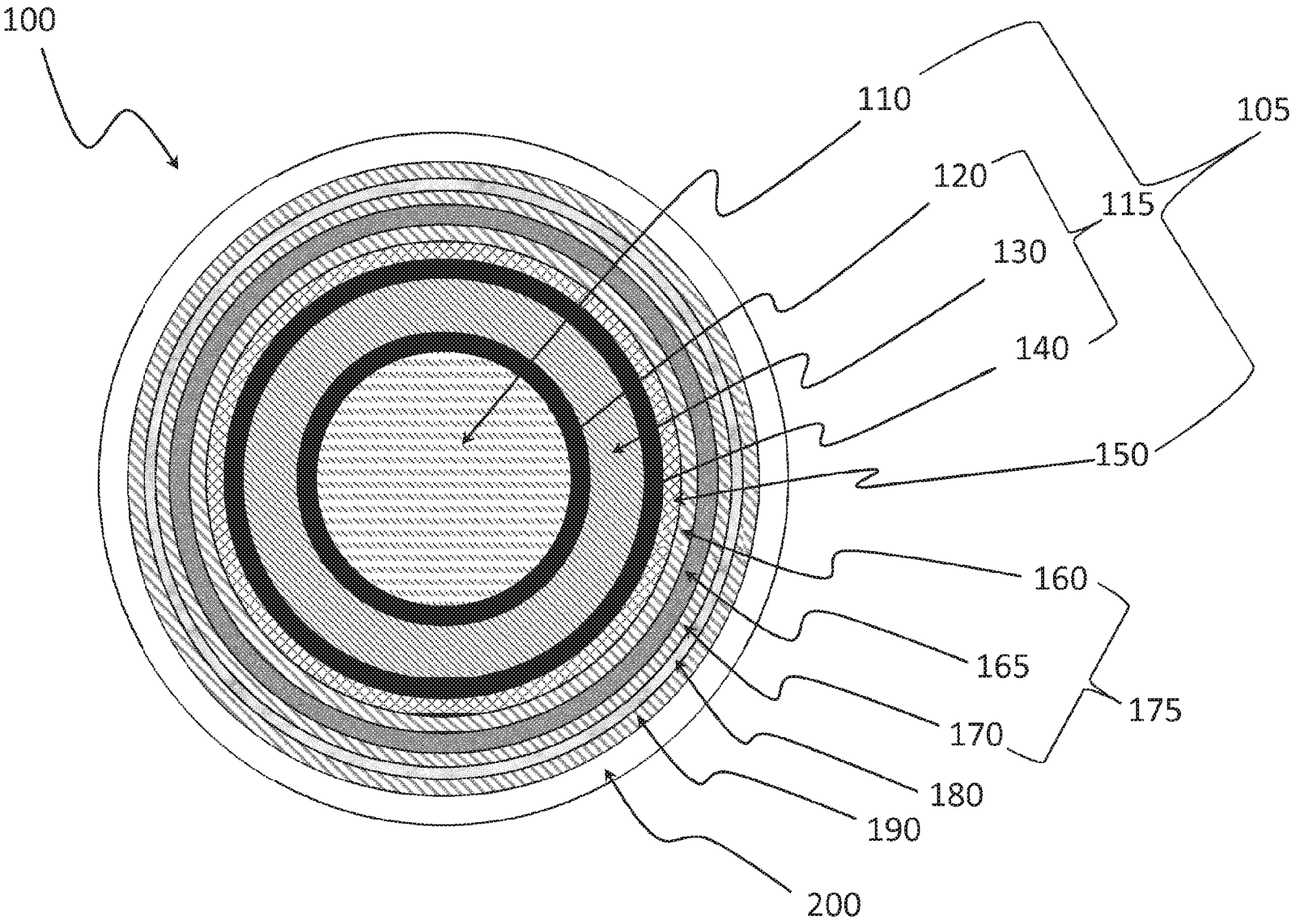
105
115
150
175
160
140
130
165
120
170
180
110
190
200
100

FIRE RESISTANT ELECTRIC CABLE

CROSS-REFERENCE TO RELATED APPLICATIONS

This application is a national phase application under 36 USC 371 that claims the benefit of PCT/EP2015/079081, filed Dec. 9, 2015, which application is hereby incorporated herein by reference.

TECHNICAL FIELD

The present invention relates to a fire resistant medium and high voltage electric cable.

BACKGROUND

Electric cables used in industrial facilities, like, for example, onshore and offshore plants, or in public infrastructures, like, for example, underground lines, require high fire resistance properties to maintain operation of the facilities or infrastructures for a certain period of time to allow evacuation of the people before the fire breaks out.

Due to the increasing amount of equipment running on medium and high voltage in the abovementioned industrial facilities or public infrastructures, there is the need of having fire resistant medium and high voltage electric cables.

Typically, medium (MV) and high voltage (HV) electric cables comprise a core and an outer sheath arranged in a radially outer position with respect to the core. The core comprises a conductor, an insulating system arranged in a radially outer position with respect to the conductor and a conductive screen arranged in a radially outer position with respect to the insulating system. The insulating system typically includes a first semiconductive layer arranged in contact with the conductor, an insulating layer arranged in a radially outer position with respect to the first semiconductive layer, a second semiconductive layer arranged in a radially outer position with respect to the insulating layer.

In specific cases, such as, for example, in off-shore plants, the electric cables also include a metallic armor radially interposed between the conductive screen and the outer sheath.

In order to provide a medium and high voltage electric cable with fire resistant properties, a fire resistant layer is typically provided in the cable to create a barrier to the fire propagation within the cable.

EP 2413331 relates to a medium voltage fire resistant electric cable comprising a first layer made of an extruded elastomeric ceramics silicone material, and an optional outer layer made of a like material, thereby providing a thermal protective barrier for the innermost layers of the cable comprising copper conductors, a semiconductor material and an insulating material sheath. In particular, the insulating material sheath is coated by an extruded silicone and ceramizing elastomeric layer. In cooperation with the ceramizing elastomeric layer, a second semiconductor material layer is further co-extruded. The cable is further provided with a screen or shield constituted by a copper strip and a thermal insulating layer including a plurality of glass fiber strips covering in turn the copper shield. The layer made of an extruded ceramizing silicone elastomeric material provides both an electrical insulation and a thermal insulation. Another glass yarn strip operates to further increase the cable fire thermal resistance.

JP 05-182532 relates to a fire resistance cable suitable for the high voltage use of 6600V class. The cable core includes an inner semiconductive layer, an insulating layer, an outer semiconductive layer, a metal shield layer and an external sheath. The cable core is surrounded by a layer of mica and cellulose pulp adhering onto a reinforcement layer made of, e.g. glass fiber. This layer is surrounded, in turn, by a foaming fire preventing layer which is foamed to be carbonized by heat. The outer sheath is made of PVC.

WO 2014/081096 and counterpart US 2011/0153968 relate to a fire resistant cable for medium or high voltage comprising a conductor, a first semiconducting layer formed outside of the conductor, a first insulation layer formed outside of the first semiconducting layer, a second semiconducting layer formed outside of the first insulation layer, a shield layer formed outside of the second semiconducting layer and a fire resistant layer provided between the first insulating layer and the second semiconducting layer. The fire resistant layer is formed by winding a mica tape two or more times.

SUMMARY

Embodiments of the present invention relate to a fire resistant medium and high voltage electric cable.

The Applicant observed that providing a fire resistant layer into the insulating system of a MV or HV cable is not advisable because any modification to this system, like the insertion of the fire resistant layer, can alter the sought electrical properties of the cable. In addition, the insertion of a fire resistant layer into the insulating system could require a significant change in the manufacturing process of the cable.

The Applicant also observed that the use of mica tapes can be disadvantageous.

Mica tape is a tape manufactured with mica flakes glued, for example with a silicone based glue, onto a substrate to enable ease of handling, the substrate being typically made of paper, polymer or glass fiber. The Applicant observed that, because of its flaky structure, mica tape can create voids within the cable, possibly generating undesired partial discharges. In addition, the flaky structure can cause easy detachment of mica from the support tape. Furthermore, winding mica tapes requires special taping machines and, during winding, mica tapes can be damaged, giving places here again to voids and/or partial discharges. Moreover, the Applicant observed that mica could flake off in a relatively short operation time (e.g. few hours) at about 90° C., thus mica tapes could be used only in MV and HV cables configured to operate for a limited time, e.g. emergency cables. Therefore, mica tapes cannot be relied upon for a continuous use at the operation conditions of MV and HV cables.

Accordingly, the Applicant believes that for MV and HV cables it is preferred to make a coextruded insulating system in which all of the layers are in direct contact with the adjacent one.

The Applicant realized that an effective and reliable barrier to the propagation of the fire towards the innermost layers of the cable can be obtained by arranging a rubberized glass fiber tape in a radially inner position with respect to the outer sheath and with the rubberized side directly contacting with the outer sheath. The rubberized side of the glass fiber tape and the outer sheath, being both made of a polymeric material, bind one to the other creating an integral assembly which, in case of fire, allows the ashes of the burnt outer sheath to remain in place and to act as a barrier to the fire propagation inside the cable. In case of fire, thanks to the presence of glass fibers in the rubberized tape, the outer sheath stay in place, carbonizes in a substantially uniform matter and creates a heat barrier preventing the temperature inside the cable to quickly and highly rise and the melted material of the insulation system to move, thus avoiding any risk of short between conductor and conductive screen.

The Applicant realized that a further fire resistant barrier can be effectively and reliably provided by arranging a heat block layer made of halogen-free flame retardant or fire resistant polymeric material in a radial outer position with respect to the cable core and in a radial inner position with respect to rubberized glass fiber tape. This layer allows delaying both propagation of the fire within the core of the cable and heat build-up in the insulation system, thus maintaining the insulation properties and ensuring operation of the cable for the desired time.

Accordingly, embodiments of the present invention relate to a fire resistant medium and high voltage electric cable that includes a conductor and a first semiconductive layer arranged in a radially outer position with respect to the conductor. An insulating layer is arranged in a radially outer position with respect to the first semiconductive layer and directly contacts the first semiconductive layer. A second semiconductive layer is arranged in a radially outer position with respect to the insulating layer and directly contacts the insulating layer. A conductive screen is arranged in a radially outer position with respect to the second semiconductive layer. A heat block layer is arranged in a radially outer position with respect to the conductive screen. The heat block layer comprises a layer made of a fire resistant or a flame retardant halogen-free material. A rubberized glass fiber tape is arranged in a radially outer position with respect to the heat block layer and has a rubberized surface outward facing. An outer sheath is arranged in a radially outer position with respect to the rubberized glass fiber tape and directly contacts the rubberized surface of the rubberized glass fiber tape.

Advantageously, in the cable of the invention the contact between the rubberized surface of the rubberized glass fiber tape and outer sheath forms, in case of fire, an effective barrier against propagation of the fire inside the cable. Such a barrier prevents the insertion of fire resistant layer/s into the insulating system.

Preferably, the rubberized glass fiber tape is bonded to the outer sheath, so as to acts as a single continuous layer. The bonding between the rubberized surface of the rubberized glass fiber tape and outer sheath can be attained while manufacturing the cable by extruding and, optionally, curing the outer sheath around the already wrapped rubberized glass fiber tape.

Advantageously, the cable of the invention further comprises a glass fiber tape radially interposed between the conductive screen and the rubberized glass fiber tape.

Preferably, a first glass fiber tape can be arranged in a radially outer position with respect to the heat block layer and, more preferably, in direct contact thereto. This glass fiber tape contributes to avoid outflow of the melted insulation, thus maintaining the insulation properties of the cable.

A second glass fiber tape is preferably radially interposed between the conductive screen and the heat block layer, more preferably in direct contact with the latter.

Preferably, the first and second glass fiber tape are made of woven glass fibers, self-supported or supported by a polymer layer, for example a rubberized layer.

When both a first and a second glass fiber tape are provided, the heat block layer is sandwiched between two glass fiber tapes which, in case of fire, aid the heat block layer material to remain in place and work as a thermal insulator.

A metallic armor can be radially interposed between the heat block layer and the rubberized glass fiber tape.

Preferably, the metallic armor is radially interposed between the first glass fiber tape and the rubberized glass fiber tape.

In preferred embodiments of the invention, the outer sheath is made of a flame retardant halogen-free material. This allows the outer sheath not to burn quickly.

The material of the outer sheath is preferably also a mud and/or oil resistant material. In particular, the outer sheath of the cable of the invention is preferably classified as SHF 2 according to IEC 60092-3600 (2014).

Preferably, the outer sheath is made of a material which is flame retardant halogen-free and mud or mud/oil resistant.

In the present description and claims, the first semiconductive layer, the insulating layer and the second semiconductive can also be collectively referred to as "insulating system."

In the present description and claims, the conductor, the first semiconductive layer, the insulating layer, the second semiconductive and the conductive screen can also be collectively referred to as "cable core" or "cable conductive core."

In the present description and claims a "semiconducting layer" is meant as a layer made of a material having semiconductive properties, such as a polymeric matrix added with, e.g., carbon black such as to obtain a volumetric resistivity value, at room temperature, of less than 500 Ω·m, preferably less than 20 Ω·m. The amount of carbon black can range between 1 and 50% by weight, preferably between 3 and 30% by weight, relative to the weight of the polymer.

In the present description and claims a "fire resistant" material is a material capable of withstanding the fire according to IEC 60331-21 (1999).

In the present description and claims, as "flame retardant" material is a material capable of delaying the flame propagation according to IEC 60332 3-22 (2009-02).

For the purpose of the present description and of the appended claims, except where otherwise indicated, all numbers expressing amounts, quantities, percentages, and so forth, are to be understood as being modified in all instances by the term "about." Also, all ranges include any combination of the maximum and minimum points disclosed and include any intermediate ranges therein, which may or may not be specifically enumerated herein.

Also, use of the "a" or "an" are employed to describe elements and components of the invention. This is done merely for convenience and to give a general sense of the invention. This description should be read to include one or at least one and the singular also includes the plural unless it is obvious that it is meant otherwise.

BRIEF DESCRIPTION OF THE DRAWINGS

Further features and advantages of the present invention will appear more clearly from the following detailed description of preferred embodiments thereof, such description being provided merely by way of non-limiting example and being made with reference to the sole FIGURE, which shows a schematic cross-section view of a fire resistant medium and high voltage electric cable according to an exemplary embodiment of the present invention.

DETAILED DESCRIPTION OF ILLUSTRATIVE EMBODIMENTS

Referring to the FIGURE, a cable is indicated with numeral reference 100. Cable 100 is designed to be used, for example, in off-shore installations.

Cable 100 comprises, in the radially innermost portion thereof, a core 105 and, in the radially outer portion thereof, an outer sheath 200.

The core 105 includes at least one conductor 110, an insulating system 115 arranged in a radially outer position with respect to the conductor 110 and a conductive screen 150 arranged in a radially outer position with respect to the insulating system 115.

The insulating system 115 comprises a first semiconductive layer 120 arranged in a radially outer position with respect to the conductor 110 and in direct contact with the conductor 110, an insulating layer 130 arranged in a radially outer position with respect to the first semiconductive layer 120 and in direct contact with the first semiconductive layer 120 and a second semiconductive layer 140 arranged in a radially outer position with respect to the insulating layer 130 and in direct contact with the insulating layer 130.

While a single core 105 is shown in the FIGURE and described below, the following description applies to multicore cables as well.

The first semiconductive layer 120 mitigates concentration of electric field inside the cable 100 by uniformly distributing charges on the surface of the conductor 110. Furthermore, the first semiconductive layer 120 minimizes degradation of the insulating layer 130, which is caused by ionization, by filling the gaps formed between the conductor 110 and the insulating layer 130.

The insulating layer 130 insulates the conductor 110 from outside by covering and protecting the conductor 110 so that current may not flow outside of the cable 100.

The second semiconductive layer 140 uniformly distributes electrical stress inside the insulation system 115.

The conductor 110 can be made of a rod or of stranded wires made of an electrically conductive metal, such as copper or aluminum. For example, the conductor 110 comprises tinned stranded and compressed copper wires.

The layers 120, 130 and 140 of the cable insulating system 115 can be made of extruded polymeric material. Examples of suitable polymeric materials are polyethylene homopolymers or copolymers, such as cross-linked polyethylene (XLPE), or elastomeric ethylene/propylene (EPR) or ethylene/propylene/diene (EPDM) copolymers, also cross-linked, or thermoplastic materials, for example propylene-based materials as disclosed in WO 02/03398, WO 04/066317, WO 04/066318, WO 07/048422, WO11/092533 and WO 08/058572. The semiconducting layers material further comprises a suitable amount of conductive filler, for example carbon black.

Layers 120, 130 and 140 forming the insulating system 115 are preferably coextruded.

The conductive screen 150 can be made of a metallic tape or a metallic braid of copper, aluminum, a copper alloy, an aluminum alloy or a combination thereof.

For example, the conductive screen 150 is made of a tinned annealed copper wire braid. The conductive screen 150 can connect the cable 100 with the ground.

A semiconducting tape (not illustrated) made, for example, of the same material of the second semiconductive layer 140 can be interposed between the conductive screen 150 and the second semiconductive layer 140.

A second glass fiber tape 160 is arranged in a radially outer position with respect to the conductive screen 150.

A polymeric tape (not illustrated) made, for example, of polyethylene terephthalate (PET) can be interposed between the second glass fiber tape 160 and the conductive screen 150. The protecting tape allows easing the stripping of the radially outer layer/s during installation.

The second glass fiber tape 160 includes glass fibers. The glass fiber tape can comprise a layer made of polymeric material, for example ethylene-propylene diene monomer (EPDM), ethylene-vinyl acetate (EVA), linear low density polyethylene (LLDPE) and mixture thereof, avoiding damaging the edges of the tape. Self-supporting (not supported by a further layer) woven glass fiber tape are also suitable.

A heat block layer 165 is arranged in a radially outer position with respect to the second glass fiber tape 160.

The heat block layer 165 is made of an extruded polymeric material which can be fire resistant or halogen-free flame retardant (LSoH). Examples of fire resistant materials are ceramifying silicone or polymer materials containing ceramifying charges. Examples of halogen-free flame retardant materials are optionally cross-linked ethylene homopolymer or copolymer or mixture thereof charged with a flame retardant filler, such as aluminum or magnesium hydroxide. Preferably, the halogen-free flame retardant material for the heat block layer of the invention is a mixture comprising ethylene vinyl acetate (EVA) and linear low density polyethylene (LLDPE) comprising from 30 wt % to 70 wt % of aluminum or magnesium hydroxide with respect to the total weight of the mixture.

A first glass fiber tape 170 is arranged in a radially outer position with respect to the heat block layer 165. The first glass fiber tape 170 is made substantially as the above in connection with the second glass fiber tape 160

When the first glass fiber tape 170 and/or the second glass fiber tape 160 comprise a layer made of polymeric material, the positioning of the layer (whether in contact with the heat block barrier 165 or not) is inconsequential.

In a preferred embodiment, both the first and the second glass fiber tapes 170, 160 are provided in radially inner and outer position with respect to the heat block layer 165 so as their support tapes are in direct contact with the heat block layer 165.

In case of fire, the second glass fiber tape 160 and the first glass fiber tape 170 firmly keep in position the heat block layer 165, so that the glass fiber tape 160, the heat block layer 165 and the glass fiber tape 170 define an assembly 175 which allows delaying both propagation of the fire within the core 105 and heat build-up in the insulation system 115.

A metallic armor 180 is arranged in a radial outer position with respect to the first glass fiber tape 170.

The metallic armor 180 can be made of a metallic tape or a metallic braid of galvanized steel, copper, aluminum, a copper alloy, an aluminum alloy or a combination thereof. The metallic armor can also perform as electric screen.

For example, the metallic armor 180 is made of a tinned annealed copper wire braid.

In certain cables applications, the metallic armor 180 can be missing.

A rubberized glass fiber tape 190 is arranged in a radially outer position with respect to the metallic armor 180.

The rubberized glass fiber tape 190 includes glass fibers, preferably in woven form, arranged on a support tape made of an elastomeric material selected, for example, from the group comprising ethylene-propylene diene monomer (EPDM), ethylene-vinyl acetate (EVA), linear low density polyethylene (LLDPE) and mixture thereof.

The elastomeric material of the rubberized glass fiber tape has the function of bonding the tape to the outer sheath during extrusion and, optionally, curing of the latter, to hold the sheath in place when burning, and of supporting the glass fibers during production to avoid damages while winding.

An outer sheath 200 is arranged in a radially outer position with respect to the rubberized glass fiber tape 190, in direct contact with the elastomeric support thereof.

The outer sheath 200 is preferably made of a halogen free, flame retardant material analogous to that used for the heat block layer. More preferably, the outer sheath 200 is made of a halogen free, flame retardant and mud and/or oil resistant polymeric material. Examples of halogen free, flame retardant and mud and/or oil resistant polymeric (preferably thermosetting) materials are alkylene/alkyl acrylate copolymer or a mixture of alkylene/alkyl acrylate copolymers, preferably having an average content of alkyl acrylate comonomer of at least 40 wt % by weight with respect to the weight of the copolymer/s, these materials being charged with a flame retardant filler, such as aluminum or magnesium hydroxide. For example, the alkylene comonomer of copolymer is an ethylene co-monomer. For example, the alkyl acrylate comonomer is selected from methyl acrylate and butyl acrylate.

The combination of rubberized glass fiber tape 190 and outer sheath 200 provide a barrier to the propagation of the fire towards the innermost layers of the cable 100.

In case of multicore cables, two or more cores are stranded, a filling material is provided into the gaps between the cores and the heat block layer or, if present, the second glass fiber tape is provided to enclose the cores and the filling material. The structure of the multicore cable in the radial outer portion with respect to the heat block layer or, if present, the second glass fiber tape is identical to the one discussed above with respect to the cable 100 of the FIGURE.

A sample of a cable having the construction of cable 100 and having the construction as from Table 1 has been subjected to fire tests according to IEC 60331-21 at 750° C.

TABLE 1

| | |
|---|---|
| Conductor | Tinned stranded and compressed copper (STCC), IEC 60228, 2004-11, class 2 |
| First semiconductive layer | ethylene-propylene rubber |
| Insulating layer | ethylene-propylene rubber, IEC 60092-360, 2014-04 |
| Second semiconductive layer | ethylene-propylene rubber |
| Conductive screen | Tinned annealed copper wire braid |
| Protecting tape | PET tape |
| Second glass fiber tape | Rubberized glass fiber tape |
| Heat block layer | EVA/LLDPE 85:15 + aluminium hydroxide (180 phr) |
| First glass fiber tape | Rubberized glass fiber tape |
| Armor | Tinned annealed copper wire braid |
| Polymeric glass fiber tape | Rubberized glass fiber tape |
| Outer sheath | ethylene vinyl acetate SHF 2 (IEC 60092-360, 2014-04) |

The cable repeatedly resisted for about 2 hours before short circuit between the conductor and the conductive screen being detected.

The invention claimed is:

1. A cable, comprising:

a conductor;

a first semiconductive layer arranged in a radially outer position with respect to the conductor;

an insulating layer arranged in a radially outer position with respect to the first semiconductive layer and directly contacting the first semiconductive layer;

a second semiconductive layer arranged in a radially outer position with respect to the insulating layer and directly contacting the insulating layer;

a conductive screen arranged in a radially outer position with respect to the second semiconductive layer;

a heat block layer arranged in a radially outer position with respect to the conductive screen, the heat block layer comprising a layer made of a fire resistant or a flame retardant halogen-free material;

a rubberized glass fiber tape arranged in a radially outer position with respect to the heat block layer and having a rubberized surface outward facing;

a first glass fiber tape radially interposed between the conductive screen and the rubberized glass fiber tape;

a second glass fiber tape radially interposed between the conductive screen and the rubberized glass fiber tape; and an outer sheath arranged in a radially outer position with respect to the rubberized glass fiber tape and directly contacting the rubberized surface of the rubberized glass fiber tape.

2. The cable according to claim 1, wherein the rubberized glass fiber tape is bonded to the outer sheath.

3. The cable according to claim 1, wherein the first glass fiber tape is radially interposed between the conductive screen and the heat block layer.

4. The cable according to claim 1, wherein the second glass fiber tape is radially interposed between the heat block layer and the rubberized glass fiber tape.

5. The cable according to claim 1, wherein:

the first glass fiber tape is radially interposed between the conductive screen and the heat block layer; and the second glass fiber tape is radially interposed between the heat block layer and the rubberized glass fiber tape.

6. The cable according to claim 1, comprising a metallic armor radially interposed between the heat block layer and the rubberized glass fiber tape.

7. The cable according to claim 6, wherein the first glass fiber tape is arranged in a radially outer position with respect to the heat block layer, wherein the metallic armor is radially interposed between the first glass fiber tape and the rubberized glass fiber tape.

8. The cable according to claim 1, wherein the outer sheath is made of a flame retardant halogen-free material.

9. The cable according to claim 1, wherein the outer sheath is made of a mud and/or oil resistant material.

10. A cable, comprising:

a conductor;

a first semiconductive layer arranged in a radially outer position with respect to the conductor;

an insulating layer arranged in a radially outer position with respect to the first semiconductive layer;

a second semiconductive layer arranged in a radially outer position with respect to the insulating layer;

a conductive screen arranged in a radially outer position with respect to the second semiconductive layer;

a first glass fiber tape arranged in a radially outer position with respect to the conductive screen;

a heat block layer arranged in a radially outer position with respect to the first glass fiber tape, the heat block layer comprising a layer made of a fire resistant or a flame retardant halogen-free material;

a second glass fiber tape arranged in a radially outer position with respect to the heat block layer;

a rubberized glass fiber tape arranged in a radially outer position with respect to the second glass fiber tape and having a rubberized surface outward facing; and an outer sheath arranged in a radially outer position with respect to the rubberized glass fiber tape.

11. The cable according to claim 10, wherein the insulating layer directly contacts the first semiconductive layer.

12. The cable according to claim 10, wherein the second semiconductive layer directly contacts the insulating layer.

13. The cable according to claim 10, wherein the outer sheath directly contacts the rubberized surface of the rubberized glass fiber tape.

14. The cable according to claim 13, wherein the rubberized glass fiber tape is bonded to the outer sheath.

15. The cable according to claim 10, wherein the outer sheath is made of a flame retardant halogen-free material.

16. The cable according to claim 10, wherein the outer sheath is made of a mud and/or oil resistant material.

17. A cable, comprising:

a conductor;

a first semiconductive layer arranged in a radially outer position with respect to the conductor;

an insulating layer arranged in a radially outer position with respect to the first semiconductive layer and directly contacting the first semiconductive layer;

a second semiconductive layer arranged in a radially outer position with respect to the insulating layer and directly contacting the insulating layer;

a conductive screen arranged in a radially outer position with respect to the second semiconductive layer;

a first glass fiber tape arranged in a radially outer position with respect to the conductive screen;

a heat block layer arranged in a radially outer position with respect to the first glass fiber tape, the heat block layer comprising a layer made of a fire resistant or a flame retardant halogen-free material;

a second glass fiber tape arranged in a radially outer position with respect to the heat block layer;

a rubberized glass fiber tape arranged in a radially outer position with respect to the second glass fiber tape and having a rubberized surface outward facing; and an outer sheath arranged in a radially outer position with respect to the rubberized glass fiber tape and directly contacting the rubberized surface of the rubberized glass fiber tape.

18. The cable according to claim 10, further comprising a metallic armor arranged in a radially outer position with respect to the second glass fiber tape.

19. The cable according to claim 17, further comprising a metallic armor arranged in a radially outer position with respect to the second glass fiber tape.

* * * * *